United States Patent [19]

Barnett et al.

[11] Patent Number: 4,668,894

[45] Date of Patent: May 26, 1987

[54] WAVEGUIDE COUPLER USING THREE OR MORE WAVE MODES

[75] Inventors: Larry R. Barnett, Manassas, Va.; J. Mark Baird, Gaithersburg, Md.

[73] Assignee: The United States of America as represented by the Secretary of the Navy, Washington, D.C.

[21] Appl. No.: 258,084

[22] Filed: Apr. 27, 1981

[51] Int. Cl.[4] ..... H01J 25/00

[52] U.S. Cl. ..... 315/4; 333/21 R; 333/251; 333/252; 315/5; 315/5.52

[58] Field of Search ..... 315/5, 3, 4, 5.51, 5.52; 333/21 R, 21 A, 251, 33, 252

[56] References Cited

U.S. PATENT DOCUMENTS

| | | | |
|---|---|---|---|
| 2,180,950 | 11/1939 | Bowen | 333/21 R |
| 2,485,031 | 10/1949 | Bradley | 333/21 R |
| 2,958,834 | 11/1960 | Symons et al. | 333/252 |
| 2,963,663 | 12/1960 | Marcatili | 333/21 R |
| 3,315,188 | 4/1967 | Scott | 333/252 |
| 3,753,171 | 8/1973 | Butwell | 333/33 |
| 4,224,576 | 9/1980 | Granatstein et al. | 315/5 |

*Primary Examiner*—Saxfield Chatmon

*Attorney, Agent, or Firm*—John L. Forrest; Alan P. Klein

[57] ABSTRACT

A coupler employing two similar sections of waveguide which extend colinearly in longitudinal succession. Adjacent ends of the guide sections are spaced apart to form a gap in the boundary of the sections. A third section of waveguide is disposed external to and coaxial with at least a part of each of the two waveguide sections to provide a boundary surrounding the gap. Electromagnetic energy propagating down one of the two similar sections of waveguide in a first mode and entering the gap is converted partly to a plurality of other modes. The converted energy is reconverted to the first mode upon reaching the other of the two similar sections of waveguide. The electric field pattern exciting the section of waveguide at the end of the gap and propagating down it is exclusively in the first mode. The cutoff-determining dimensions of the third section of waveguide and the gap separation are determined from the condition that the phase relationships between the modes at the end of the gap be the same, to within an integral multiple of $2\pi$, as what they were at the beginning of the gap, to insure complete transfer of power between the two similar sections of waveguide.

11 Claims, 9 Drawing Figures

WAVEGUIDE COUPLER USING THREE OR MORE WAVE MODES

BACKGROUND OF THE INVENTION

The present invention relates generally to waveguides and, more particularly, to waveguide couplers having low transmission losses.

Waveguide couplers are used to transfer energy from one waveguide to another. A coupler employing input and output circular waveguides propagating the $TE_{01}$ mode is disclosed in U.S. Pat. No. 2,960,670 issued to E. A. J. Marcatili on 15 Nov. 1960, wherein coupling is accomplished by exciting both the $TE_{01}$ and $TE_{02}$ modes in a gap region between the guides. However, the transmission loss of this coupler is higher than desired for some applications.

One very important operation in microwave transmission systems is the transfer of energy from an evacuated microwave tube to a gas-filled waveguide. Heretofore, a dielectric diaphragm, or window, has been provided at the input port of the waveguide to accomplish this purpose. However, the diaphragm often is unable to withstand the power loading, and breakdown of the diaphragm can occur. One solution to this problem is to flare the waveguide and insert the diaphragm well inside the guide at a larger cross section where the power loading per unit area is less. Unfortunately, the flaring of the guide introduces unwanted higher wave modes. If the waveguide section beyond the diaphragm is tapered to reduce the number of modes, a resonant cavity for the unwanted modes can be formed, resulting in increased losses for the system.

Another important operation in microwave transmission systems is the separation of the output microwave energy from the electron beam in a relativistic electron cyclotron maser or gyrotron. Heretofore, the electron beam has been collected on the walls on the output waveguide. For high power operation, the surface area of the walls must be increased. If the guide is flared and then tapered to increase the surface area, resonant losses from unwanted high wave modes again occur.

SUMMARY OF THE INVENTION

Accordingly, it is an object of the present invention to transfer energy from one waveguide to another with the lowest possible transmission loss.

Another object is to efficiently transfer energy from an evacuated microwave tube to a gas-filled waveguide.

A further object is to efficiently collect the electron beam from a high power relativistic electron cyclotron maser or gyrotron.

These and other objects of the present invention are achieved by a coupler employing first and second sections of waveguide extending colinearly in longitudinal succession. Adjacent ends of the waveguide sections are spaced apart a given distance to form a gap in the boundary of the sections. Means is provided for converting electromagnetic wave energy entering the gap from the first waveguide section in a first mode partly to a plurality of other modes and reconverting the converted energy to the first mode upon reaching the second waveguide section. The phase relationships between the modes at the end of the gap are the same, to within an integral multiple of $2\pi$, as what they were at the beginning of the gap. The coupler provides efficient transmission and very low reflection over a significant bandwidth. It has many applications, particularly for high power microwave energy generation and usage, in which transitions to large diameter waveguide are necessary.

DESCRIPTION OF THE PREFERRED EMBODIMENTS

Figure 1:
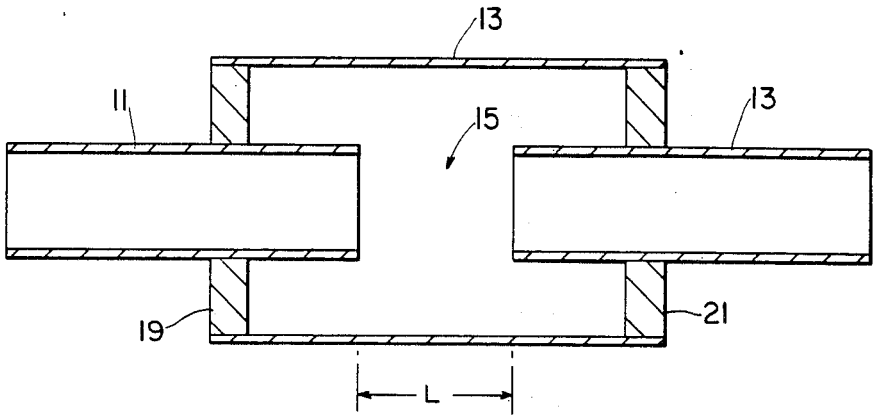
FIG. 1 is a sectional view of a coupler constructed in accordance with the present invention.

Referring to FIG. 1, the coupler includes two similar sections 11 and 13 of hollow waveguide which extend colinearly in longitudinal succession. Adjacent ends of the guides 11 and 13 are spaced apart a distance L to form a gap 15 in the boundary formed by the guides. The guides 11 and 13 have the same cutoff determining dimensions $q_i$ and are proportioned to support one or more modes of wave energy propagation at frequency f to the exclusion of other modes. Each mode is characterized by a unique phase constant defined as the phase change in the wave per unit distance traveled.

The other component of the coupler is a mode-converting means which is disposed at the gap 15. The mode-converting means converts electromagnetic energy entering the gap 15 from guide 11 in a first mode whose phase constant in the gap is $k_1$ partly to a plurality of other modes (of phase constants $k_2$, $k_3$, $k_4$, etc. and reconverts the converted energy to the first mode upon reaching guide 13 such that the phase relationships between the modes at the end of the gap are the same, to within an integral multiple of $2\pi$, as what they were at the beginning of the gap, i.e. $\Delta k=(2\pi/L)$, or an integral multiple of $(2\pi/L)$, where $\Delta k=k_1-k_2$, or $k_2-k_3$, or $k_1-k_3$ etc. While the mode-converting means may take a variety of forms, conveniently it may take the form illustrated in FIG. 1 of another section 17 of hollow waveguide disposed external to and coaxial with at least a part of each of the guides 11 and 13 to provide a boundary surrounding the gap 15. Hollow supports 19 and 21, made of a suitable metal or dielectric, support each of the guides 11 and 13 in their coaxial positions within guide 17. The supports 19 and 21 surround guides 11 and 13 and otherwise completely fill guide 17. Guide 17, by virtue of its larger cutoff-determining dimensions $q_e$, is proportioned to support three or more modes of wave energy propagation at frequency f to the exclusion of other modes.

In operation of the coupler thus described, electromagnetic wave energy of frequency f is excited at the left-hand end of guide 11 exclusively in a single mode. This energy propagates to the right along guide 11 until it reaches coupling gap 15. Immediately upon entering the gap wherein both this mode, having a phase constant $k_1$ in the gap, and the modes of phase constants $k_2$ and $k_3$, for example, may be supported, the wave energy comprises all of these modes, the respective modes in the gap being excited in varying amounts by the mode in guide 11. The coupling coefficient for excitation of a particular output mode in the gap 15 by the exciting mode in guide 11 can be determined from the expression $$C_j^i = \iint_s \vec{e}_j \cdot \vec{e}_i ds,$$

where $\vec{e}_j$ is the exciting mode vector and $\vec{e}_i$ is the output mode vector, the mode vectors being normalized in their respective regions, i.e.

$$\iint_s \vec{e}_j \cdot \vec{e}_j ds = 1.$$

Since the different modes have different phase constants, they will continue propagating along the gap 15 in the direction of guide 13 at unequal velocities. The relation $\Delta k = (2\pi/L)$ or an integral multiple of $(2\pi/L)$ insures that the mode vectors at the end of the gap near guide 13 are in phase. Accordingly, guide 13 is excited by the energy which initially entered guide 11. Furthermore, the electric field pattern exciting guide 13 and propagating down guide 13 and out its right-hand end is exclusively in the single mode that propagated down guide 11. The coupling coefficients for excitation of the mode in guide 13 by the modes in the gap 15 can be determined from the expression $$C_i^j = \iint_s \vec{e}_i \cdot \vec{e}_j ds$$

where $\vec{e}_i$ is the exciting mode vector and $\vec{e}_j$ is the output mode vector. The amplitude of coupling between guides 11 and 13 via excitation of a given gap mode whose mode vector is $e_i$ is given by the product of the coupling coefficient $C_j^i$ for excitation of the gap mode by the exciting mode in guide 11 times the coefficient $C_i^j$ for excitation of the output mode in guide 13 by the gap mode, which product from the identity $C_i^j = C_j^i$ just equals $|c_j^i|^2$. The voltage coupling of the coupler is found by calculating the respective amplitude of coupling for each mode in the gap and then taking the sum of the coupling amplitudes. The power transmission of the coupler is proportional to the square of the voltage coupling.

Figure 2:
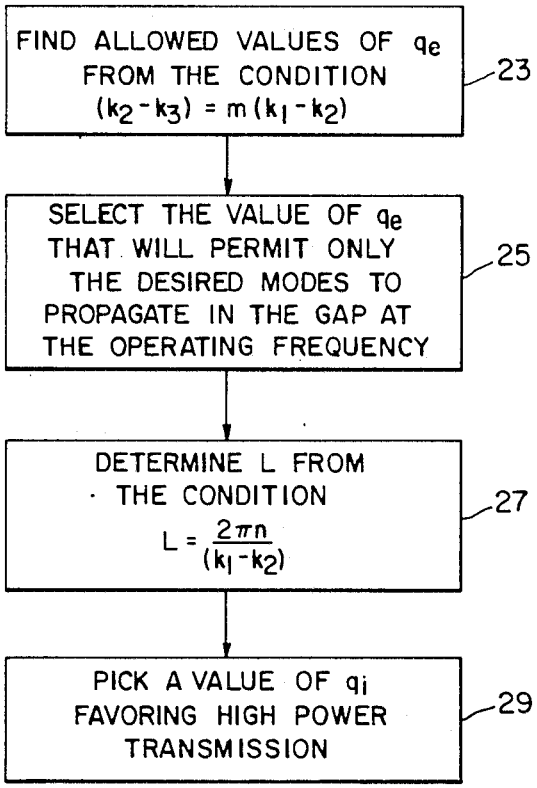
FIG. 2 is a flow chart depicting the steps in determining values for the parameters of the coupler.

Referring to the flow chart shown in FIG. 2, a method of determining the operating values for the parameters $q_e$, L and $q_i$ of the coupler will now be discussed.

In the first step 23, the allowed values of $q_e$ are found from the condition $$(k_2 - k_3) = m(k_1 - k_2), \tag{1}$$

where:

- $(k_2 - k_3)$ denotes the difference between the phase constants of one pair of propagating modes in the gap,
- $(k_1 - k_2)$ denotes the difference between the phase constants of another pair of propagating modes in the gap, and
- m is an integer.

Condition (1) follows from the requirement that $\Delta k = (2\pi/L)$ or an integral multiple of $(2\pi/L)$. The phase constant of the $l^{th}$ mode is given by $$k_l = \frac{2\pi f}{c}\left[1 - \frac{f_{col}^2(q_e)}{f^2}\right]$$

where:

- f is the operating frequency of the coupler,
- c is the speed of light,
- $f_{col}$ is the cutoff frequency of guide 15 for the lth mode, which is a function of $q_e$. Substituting for $k_l$, condition (1) can be rewritten conveniently as:

$$\left(1 - \frac{f_{co2}^2}{f^2}\right)^{\frac{1}{2}} - \left(1 - \frac{f_{co3}^2}{f^2}\right)^{\frac{1}{2}} = m\left[\left(1 - \frac{f_{co1}^2}{f^2}\right)^{\frac{1}{2}} - \left(1 - \frac{f_{co1}^2}{f^2}\right)^{\frac{1}{2}}\right] \tag{1'}$$

There will be a set of values of $q_e$ that will satisfy this condition.

The second step 25 comprises selecting the value of $q_e$ that will permit only the desired modes to propagate in the gap 15 at the operating frequency.

Next the third step 27 is performed, whereby L is determined from the condition $$L = \frac{2\pi n}{(k_1 - k_2)} \tag{2}$$

where:

- $(k_1 - k_2)$ denotes the difference between the phase constants of one pair of propagating modes in the gap, and
- n is an integer.

Condition (2) also follows from the requirement $\Delta k = (2\pi/L)$ or an integral multiple of $(2\pi/L)$. Substituting for $k_l$, condition (2) can be rewritten conveniently as $$L = \frac{n(f/c)}{\left[\left(1 - \frac{f_{col}^2}{f^2}\right)^{\frac{1}{2}} - \left(1 - \frac{f_{co2}^2}{f^2}\right)^{\frac{1}{2}}\right]} \tag{2'}$$

The fourth step 29 comprises picking a value of $q_i$ favoring high power transmission by the coupler. The power transmission can be calculated (to within a constant factor) by evaluating the voltage coupling coefficients $C_j^i$, summing their squares to obtain the voltage coupling, and squaring the voltage coupling. The value of the power transmission thus obtained is a function of the ratio of $q_i$ and $q_e$ through the dependence of the $C_j^i$ on $q_i$ and $q_e$. Since $q_e$ is fixed by the second step of the parameter-determining method, $q_i$ can be varied to obtain an optimal value for the power transmission.

For a clearer understanding of the method of determining the operating values for the parameters of the coupler, an example of it is set forth below. This example is merely illustrative and is not to be understood as limiting the scope and underlying principles of the invention in any way.

EXAMPLE

A coupler was designed for operation at f=35 GHz employing circular waveguides. The $TE_{01}$ circular mode was selected as the mode excited in guide 11. The $TE_{01}$, $TE_{02}$ and $TE_{03}$ modes were the modes selected to be supported in the gap at the frequency f to the exclusion of the other modes.

In step 1, the set of allowed values of $R_e$ was found from condition (1') with m=2 and the cutoff frequencies of the $TE_{03}$, $TE_{02}$ and $TE_{01}$ modes substituted for $f_{co3}$, $f_{co2}$ and $f_{co1}$ respectively, i.e.

$$f_{co3} = \frac{(10.173)c}{2\pi R_e}$$

$$f_{co2} = \frac{(7.016)c}{2\pi R_e}$$

$$f_{co1} = \frac{(3.832)c}{2\pi R_e} \quad .$$

In step 2, a specific value of $R_e$ was selected from the set of allowed values determined in step 1 such that $$f_{co4} = \frac{(13.323)c}{2\pi R_e}$$

was greater than f (so that $TE_{04}$ would be cutoff in the gap), but $$f_{co3} = \frac{(10.173)c}{2\pi R_e}$$

was less than f (so that $TE_{03}$ and lower modes propagate).

In step 3, L was determined from condition (2') with n=1 and $R_e$ equal to the value selected in step 2.

In step 4, a value of $R_i$ was chosen as follows:

First the coupling coefficients to the $TE_{01}$, $TE_{02}$ and $TE_{03}$ modes at the left-hand end of the gap (taken as z=0) when excited by a $TE_{01}$ input were calculated from the expression for $c_j^i$, i.e., $$C_{01}^{01} = \frac{2}{J_2^2(X'_{01})R_iR_e} \int_0^{R_i} J_1\left(\frac{X'_{01}}{R_i}\rho\right) J_1\left(\frac{X'_{01}}{R_e}\right) \rho d\rho$$

$$C_{01}^{02} = \frac{2}{J_2(X'_{01})J_2(X'_{02})R_iR_e} \int_0^{R_i} J_1\left(\frac{X'_{01}}{R_i}\rho\right) J_1\left(\frac{X'_{02}}{R_e}\right) \rho d\rho$$

$$C_{01}^{03} = \frac{2}{J_2(X'_{01})J_2(X'_{03})R_iR_e} \int_0^{R_i} J_1\left(\frac{X'_{01}}{R_i}\rho\right) J_1\left(\frac{X'_{03}}{R_e}\right) \rho d\rho$$

using the definition of the mode vectors:

$$\vec{e} = u_z \hat{X} \nabla_t \psi$$

where for the circular electric modes $$\psi_{0n} \propto J_0\left(\frac{X'_{0n}\rho}{R_e}\right) e^{-jk_{0n}z}$$

and $J_n(y)$ is the nth order Bessel function.

Figure 3:
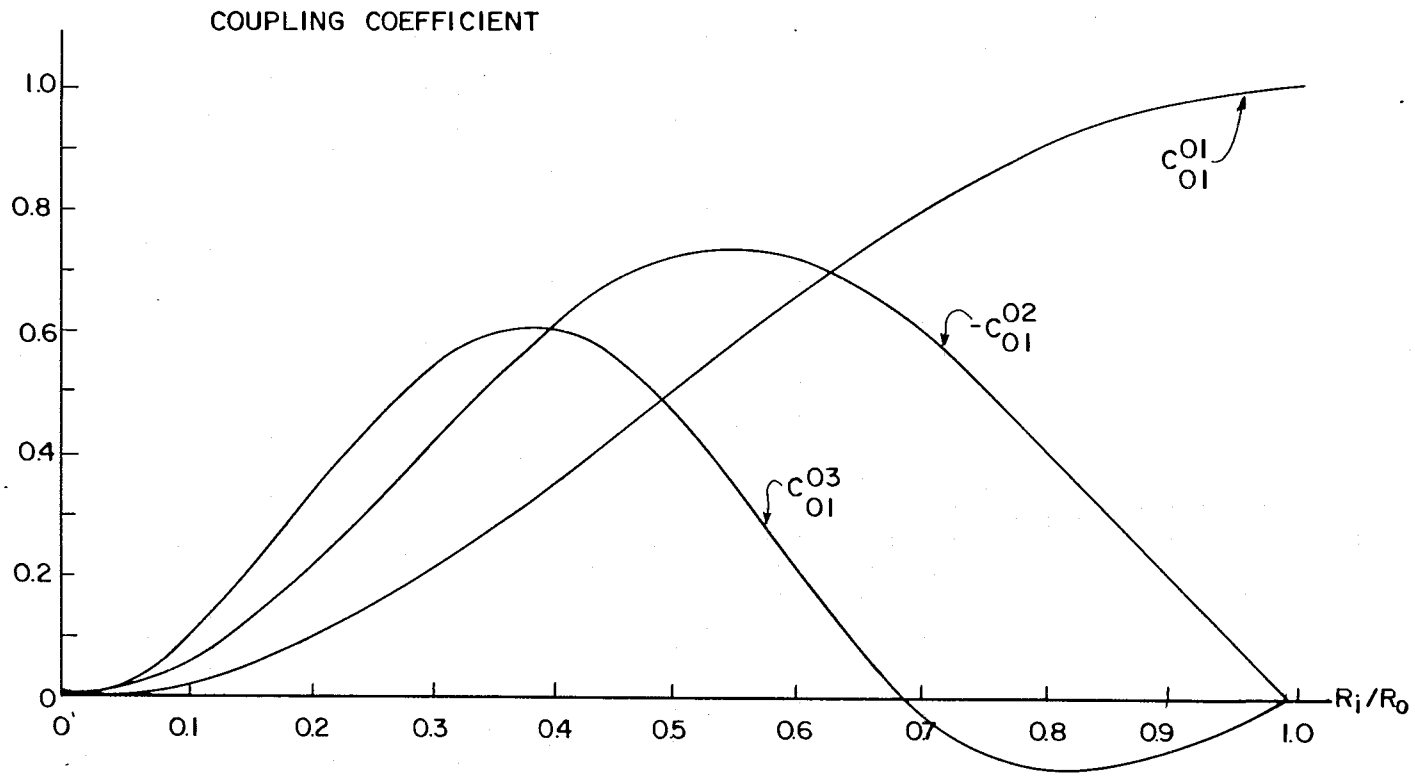
FIG. 3 is a plot of the coupling coefficients as functions of $R_i/R_e$ for the lowest three circular guide modes.

FIG. 3 shows the $c_j^i$ plotted as functions of $(R_i/R_e)$. Next, the voltage coupling was calculated as $$V = (C_{01}^{01})^2 + (C_{01}^{02})^2 + (C_{01}^{03})^2.$$

Figure 4:
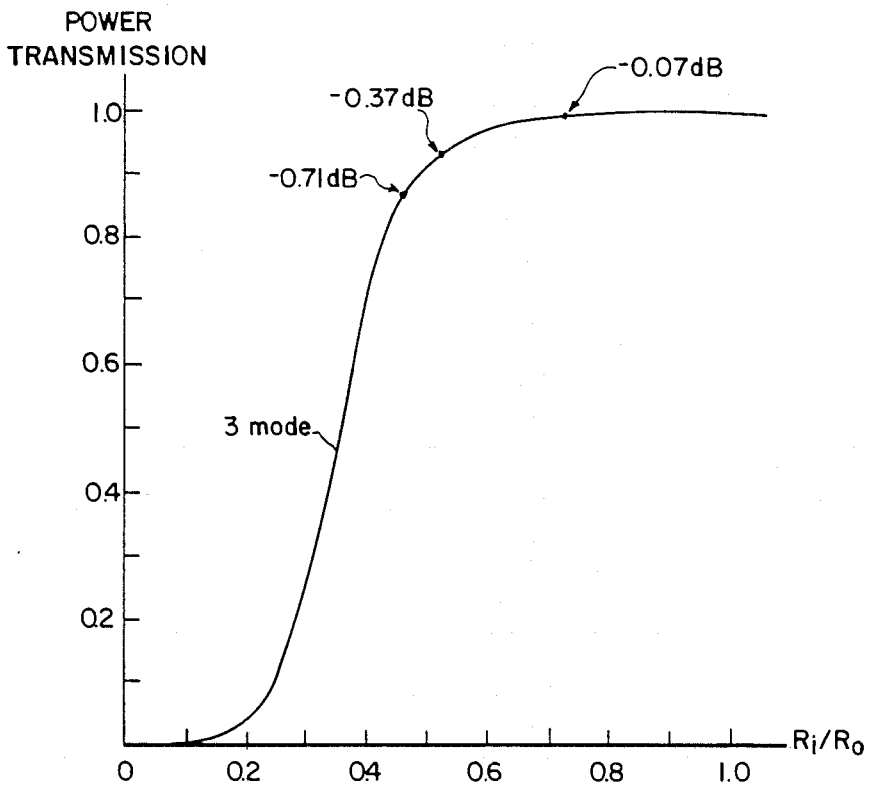
FIG. 4 is a plot of the power transmission as a function of $R_i/R_e$.

Then, the power transmission was calculated as $P = aV^2$, where a is a constant. FIG. 4 shows P plotted as a function of $(R_i/R_e)$. Finally, a value of $(R_i/R_e)$ was selected for which P was high.

Table 1 summarizes the operating values determined by the method outlined above, and the properties of a coupler employing these values:

TABLE I

| | |
|---|---|
| $R_e$ | 1.687 cm. |
| L | 6.71 cm. |
| $R_i$ | (0.55) $R_e$ |
| Bandwidth at given loss | 2.0 GHz |
| Loss | 0.05 dB |
| Maximum reflection at 35.0 GHz | −30 dB |
| Reflection at band edges | −23 dB |

MODIFICATIONS

Reference is now made to the devices shown in FIGS. 5–9 which are similar to the coupler described above.

Figure 5:
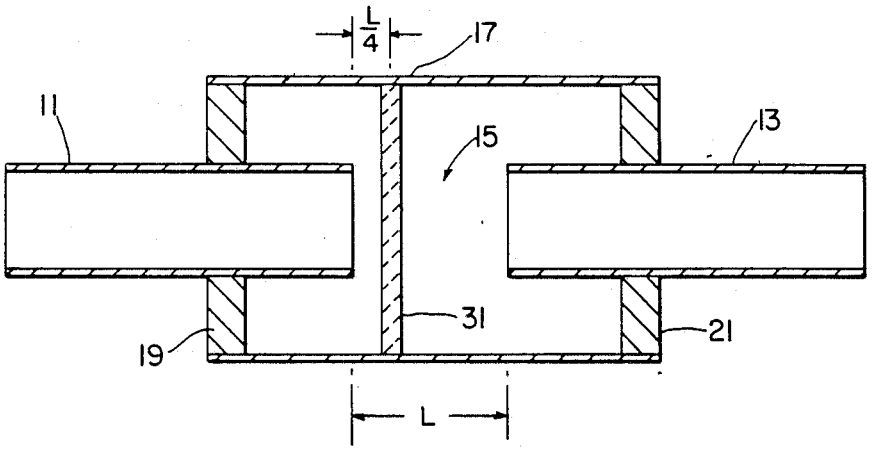
FIGS. 5–9 show modifications of the coupler of FIG. 1.

The difference in the coupler of FIG. 5 is the addition of a dielectric diaphragm 31 which permits the device to be used as a coupler of electromagnetic energy from an evacuated microwave tube to a gas-filled waveguide. The diaphragm 31 has the same transverse cross-section as guide 17 and is fitted inside guide 17 at a distance of approximately (L/4) from either of the adjacent ends of the guides 11 and 13. It has been found that the peak field strength at these positions is less than that of a pure $TE_{01}$ mode in guide 17. Therefore, power loading of the diaphragm and the chance of breakdown are less than if the diaphragm were simply inserted in a section of waveguide attached to the microwave tube, as in the prior art.

Figure 6:
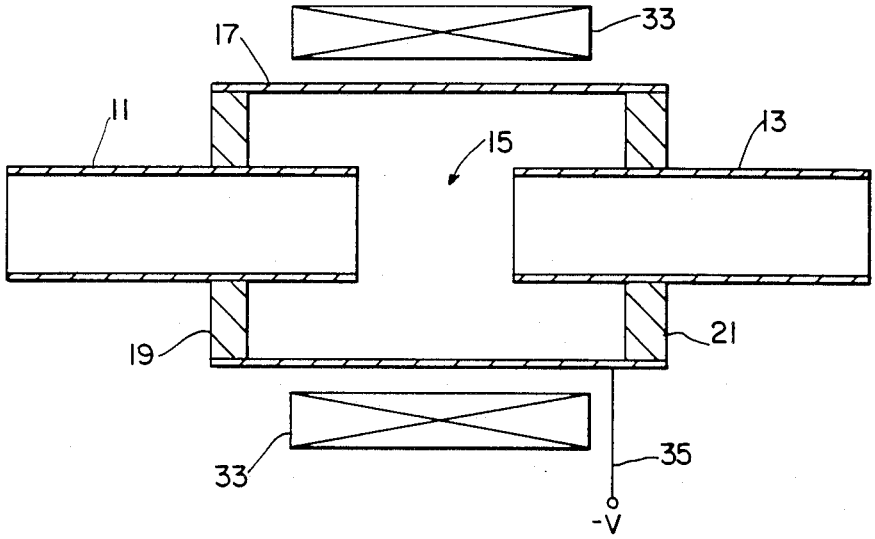

The difference in the coupler of FIG. 6 is the addition of means, such as solenoid windings 33 surrounding guide 17, for producing a diverging axial magnetic field in the region of the gap 15, and of means, such as electrode 35, for applying a negative potential to guide 17. This device can be substituted for the collector portion of a relativistic electron cyclotron maser or gyrotron such as described, for example, in U.S. Pat. No. 3,398,376 which issued to J. L. Hirschfield on 20 Aug. 1968. Electrons leaving the interaction region of the gyrotron and traveling down guide 11 are deflected to the walls of guide 17 and collected thereon, while the electromagnetic energy passes out guide 13. The surface area of the walls of guide 17 can be made much larger than that which would be obtained by using a single waveguide for the collector, as in the prior art.

Figure 7:
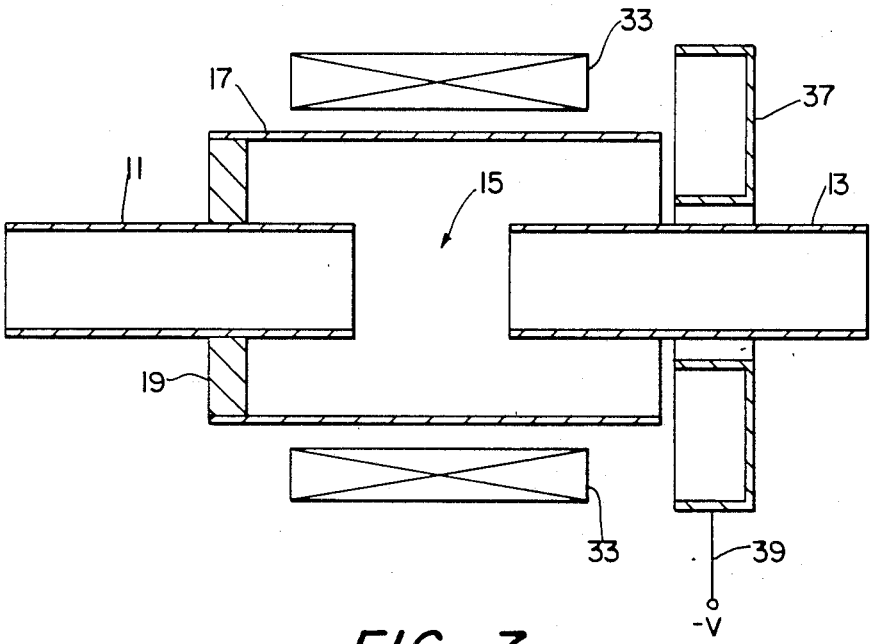

The difference in the coupler of FIG. 7 is the omission of the support 21 at the right-hand end of the gap 15, and the addition of means, such as solenoid windings 33 surrounding guide 17, for producing a diverging axial magnetic field in the region of the gap 15, of a hollow collector 37 disposed external to and coaxial with guide 13, and of means, such as electrode 39, for applying a negative potential to the collector. As with the coupler of FIG. 6, this device can be substituted for the collector portion of a relativistic electron cyclotron maser or gyrotron. Electrons leaving the interaction region of the gyrotron and travelling down guide 11 are deflected through the ring-like region between guides 17 and 13 to the collector 37, while the electromagnetic energy passes out guide 13. The surface area of the collector 37 can be made much larger than that which would be obtained by using a single waveguide for the collector, as in the prior art.

Figure 8:
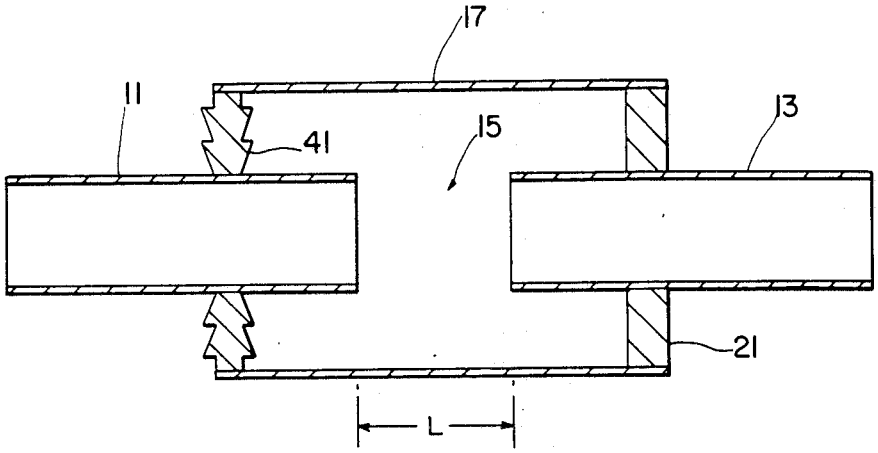

The difference in the coupler of FIG. 8 is the substitution for support 19 of a high-voltage insulator 41 which permits the device to be used as a coupler between a very-high-voltage microwave tube and its grounded output waveguide.

Figure 9:
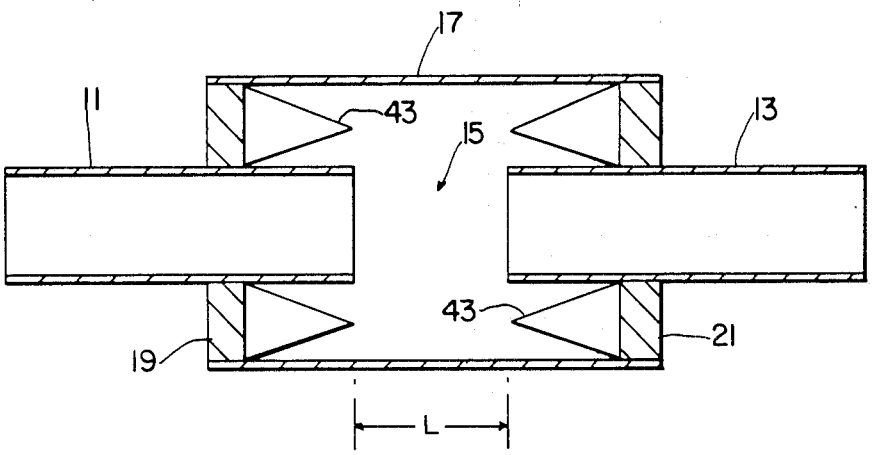

The difference in the coupler of FIG. 9 is the addition of microwave absorbing material 43. The microwave absorbing material 35 is disposed in the empty regions between guide 17 and guides 11 and 13 to attenuate any spurious modes in guide 17 which may arise, for example, if the wave energy excited at the left-hand end of the guide 11 is not exclusively in a single mode.

Obviously, numerous other modifications and variations of the present invention are possible in light of the above teachings. It is therefore to be understood that within the scope of the appended claims the invention may be practiced otherwise than specifically described herein.

What is claimed as new and desired to be secured by Letters Patent of the United States is:

1. A low-loss coupler comprising:

first and second sections of waveguide extending colinearly in longitudinal succession with adjacent ends spaced apart a given distance to form a gap in the boundary of the sections; and means for converting electromagnetic wave energy entering the gap from the first waveguide section in a first mode partly to a plurality of other modes and reconverting the converted energy to the first mode upon reaching the second waveguide section such that the phase relationships between the modes at the end of the gap are the same, to within an integral multiple of $2\pi$, as what they were at the beginning of the gap.

2. The coupler recited in claim 1, wherein the mode-converting means includes:

a third section of waveguide disposed external to and coaxial with at least a part of each of the first and second waveguide sections to provide a boundary surrounding the gap.

3. The coupler recited in claim 2 wherein:

the third waveguide section has cutoff-determining dimensions which are related to the operating frequency f of the coupler by the relation $$\left(1-\frac{f_{co2}^2}{f^2}\right)^{\frac{1}{2}}-\left(1-\frac{f_{co3}^2}{f^2}\right)^{\frac{1}{2}}=m\left[\left(1-\frac{f_{co1}^2}{f^2}\right)^{\frac{1}{2}}-\left(1-\frac{f_{co1}^2}{f^2}\right)^{\frac{1}{2}}\right]$$

where m is an integer, and $f_{co1}$, $f_{co2}$ and $f_{co3}$ are cutoff frequencies of the third waveguide section for any three of the modes, the cutoff frequencies being explicit functions of the cutoff determining dimensions.

4. The coupler recited in claim 3 wherein:

the gap separation L is related to the cutoff-determining dimensions of the third waveguide by the relation $$L=\frac{n(f/c)}{\left[\left(1-\frac{f_{co1}^2}{f^2}\right)^{\frac{1}{2}}-\left(1-\frac{f_{co2}^2}{f^2}\right)^{\frac{1}{2}}\right]}$$

where n is an integer, and c is the speed of light.

5. The coupler recited in claim 4 wherein:

the first, second and third waveguide sections are circular waveguides, the first mode is the $TE_{01}$ circular mode, and the cutoff-determining dimensions of the third waveguide section are selected to cutoff the $TE_{04}$ mode.

6. The coupler recited in claim 2 including:

a dielectric diaphragm fitted inside the third section of waveguide.

7. The coupler recited in claim 2 including;

means for producing a diverging axial magnetic field in the gap; and means for applying a negative potential to the third section of waveguide.

8. The coupler recited in claim 2 including:

means for producing a diverging axial magnetic field in the gap;

a hollow collector disposed external to the second section of waveguide; and means for applying a negative potential to the collector.

9. The coupler recited in claim 2 including:

a high-voltage insulator supporting one of the sections of waveguide in its coaxial position within the third section of waveguide.

10. The coupler recited in claim 2 including:

microwave absorbing material disposed in the regions between the third section of waveguide and the first and second sections of waveguide.

11. A method of low-loss coupling of electromagnetic waves comprising:

providing first and second sections of waveguide extending colinearly in longitudinal succession with adjacent ends spaced apart a given distance to form a gap in the boundary of the sections;

selecting the gap separation such that the phase relationships between the modes at the end of the gap are the same, to within an integral multiple of $2\pi$, as what they were at the beginning of the gap;

converting electromagnetic wave energy entering the gap from the first waveguide section in a first mode partly to a plurality of other modes; and reconverting the converted energy to the first mode upon reaching the second waveguide.

* * * * *